United States Patent [19]

Bäckström et al.

[11] 4,338,147

[45] Jul. 6, 1982

[54] METHOD AND APPARATUS FOR WINDING A WEB UPON A CORE HAVING A STRIPE OF HOT-MELT ADHESIVE

[75] Inventors: Per-Ole Bäckström; Jorma Virolainen, both of Karhula, Finland

[73] Assignee: A. Ahlstrom Osakeyhtio, Noormarkku, Finland

[21] Appl. No.: 203,528

[22] Filed: Nov. 3, 1980

Related U.S. Application Data

[62] Division of Ser. No. 14,951, Feb. 26, 1979.

[30] Foreign Application Priority Data

Jun. 21, 1978 [FI] Finland ..... 781977
Sep. 20, 1978 [FI] Finland ..... 782865

[51] Int. Cl.[3] ..... B65H 81/00

[52] U.S. Cl. ..... 156/187; 156/446; 156/457; 242/56 R

[58] Field of Search ..... 242/56.1, 56.6, 67.1, 242/56 R, 164, 165, 173, 125.1; 156/187, 188, 185

[56] References Cited

U.S. PATENT DOCUMENTS

| | | | |
|---|---|---|---|
| 2,512,900 | 6/1950 | Kwitek | 242/56.6 |
| 3,719,332 | 3/1973 | McLain | 242/125.1 |
| 3,841,578 | 10/1974 | Dorfel | 242/56 R |
| 4,153,493 | 5/1979 | Hollander et al. | 242/56.1 X |

*Primary Examiner*—David A. Simmons
*Attorney, Agent, or Firm*—Bucknam and Archer

[57] ABSTRACT

The present invention relates to a core made of cardboard or other such material. The core is covered with hot melt glue so that the end of a web of material to be wound on it can be secured to it. The invention also relates to a method of manufacturing the core in a helical winding machine, a method of using the core for winding a web of material and an apparatus for using the core for winding webs of material. The web of material is secured to the core by heating the glue up to its melting point and pressing the web against the core.

2 Claims, 6 Drawing Figures

METHOD AND APPARATUS FOR WINDING A WEB UPON A CORE HAVING A STRIPE OF HOT-MELT ADHESIVE

This is a divisional of application Ser. No. 014,951, filed Feb. 26, 1979

The present invention relates to a helically wound core, made of strips of cardboard, paper of other such material, to which the leading end of a web of material to be wound on the core is secured. The invention also relates to a method of manufacturing such a core, a method of using the core for winding webs of material and an apparatus for using the core for winding.

In the production and treatment of various webs of material, eg. in the paper and textile industries, the webs are usually wound into rolls on cores which are mostly made of cardboard. Before the winding is initiated the leading end of the web must be secured to the core. This is usually done by using adhesives, whereby either the core or the side of the web facing the core is coated with glue or an adhesive stripe is introduced between the web and the core. The web can also be secured to the core by means of staples or other such means introduced from the outside of the web as disclosed in the German patent application OS No. 2709684.

The conventional methods of securing the leading end of the web to the core involve disadvantages which can be eliminated by the present invention. One object of the invention is to provide a core to which the leading end of the web can easily and rapidly be secured when the web is transferred from a fully wound roll to a new core, whereby delays are avoided.

Another object is to provide a method of securing a web to a core which does not cause damage to the web or soiling of the rolling equipment or its surroundings. This is mainly achieved by means of coating the core at least partially with hot melt glue which becomes adhesive when heated. The glue on the core is preferably made to form one or more helical stripes.

The most preferable way of applying the glue on the core is to transfer it to the surface of the core by means of a stationary means when manufacturing the core by the helical winding method so that due to the rotational forward movement of the core a helical glue stripe is generated on its surface.

In using a core according to the invention for winding webs of material the glue layer is at least partially heated up to a temperature at which it melts, when the web is transferred from a fully wound roll to a new core, and the web is secured to the core by pressing it against the heated glue layer whereafter the pressing is terminated and the web of material is cut between the fresh core and the fully wound roll.

The apparatus for using a core according to the invention for winding webs of material comprises two parallel supporting drums which support the roll when the web of material is wound on a core; means for bringing a new core onto the supporting drums; means for removing a fully wound core from its position on the supporting drums; means for causing the web of material to run along the periphery of the new core; and means for severing the web between the new core and the fully wound roll after the web has been secured to the core. The apparatus is characterized by means for heating glue on the core up to its melting point from the side of the web of material not facing the core and for pressing the web of material against the heated glue.

A preferred embodiment of the apparatus comprises two parallel supporting drums which support the roll when the web of material is wound on a core and from between which the web is brought to the roll by using one of the supporting drums as a guiding means; means for bringing a new core onto the supporting drums; means for pushing away a fully wound roll so that a gap is created between the fully wound roll and the supporting drum guiding the web, while the roll is being supported by the opposite supporting drum; and means for severing the web between the new core and the fully wound roll after the web has been secured to the core and is characterized by means for heating glue on the core up to its melting point from the side of the web of material not facing the core and for pressing the web of material against the heated glue; means for bringing the heating and pressing means to the core through the gap between the roll and the supporting drum and for returning the means to a position beside the supporting drum.

The invention is described in more detail in the following with reference to the annexed drawings of which FIG. 1 illustrates the manufacturing method of a core according to the invention;

Figure 1:
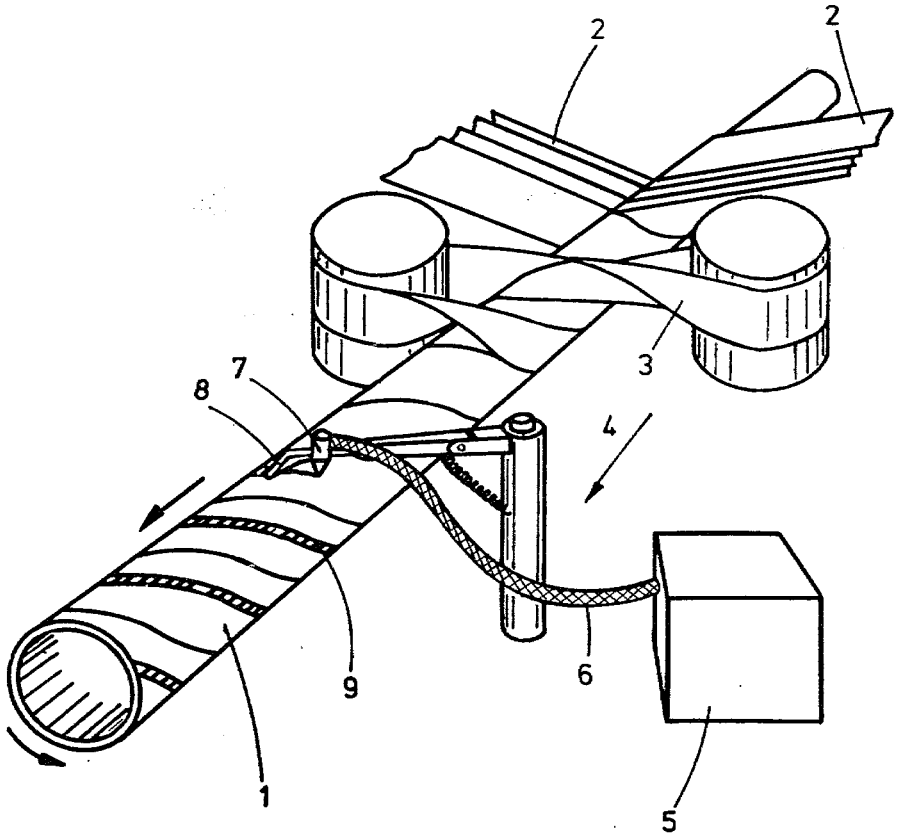

In FIG. 1 reference number 1 indicates a core made of a strip of cardboard 2 in a continously operating helical core winder according to a method know per se. The core is rotated and fed forward by means of an endless driving belt 3. A cutting device, not shown in the drawing, is used for cutting the completed core into sections of desired length. A means for feeding glue 4, in which hot melt glue is melted by heating, comprising a glue container 5 and a pump has been mounted beside the core between the cutting device and the driving belt. The molten glue is fed onto the core through a pipe 6 and a nozzle 7 and is then spread and smoothed by means of a spreading device 8. The nozzle is stationary but due to the rotational forward movement of the core a helical glue stripe 9 is generated on the surface of the core.

Alternatively, the glue can be supplied to the core by means of a rotating roll which when coming into contact with the surface of the core transfers glue to it. The glue used can be a hot melt glue (thermoplastic glue), containing waxes, polyethylene and ethyl vinyl acetate, which is applied in a molten state or a glue dispersed in water, eg. a polyvinyl acetate dispersion, which is applied cold.

The glue can be dyed o that cores used for different purposes can be provided with glue stripes of different colour.

Figure 2:
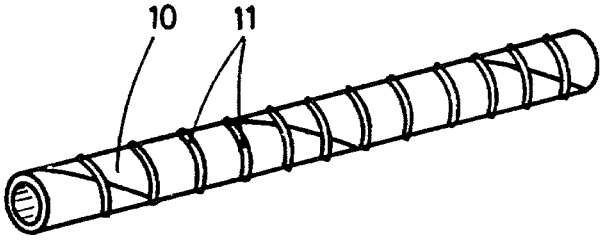
FIGS. 2 and 3 show two alternative embodiments of the core.

FIG. 2 shows an alternative embodiment in which a helical core 10 has been provided with spaced annular glue stripes 11 the width of which and the space between which are chosen so as to give the required adhesitivity.

Figure 3:
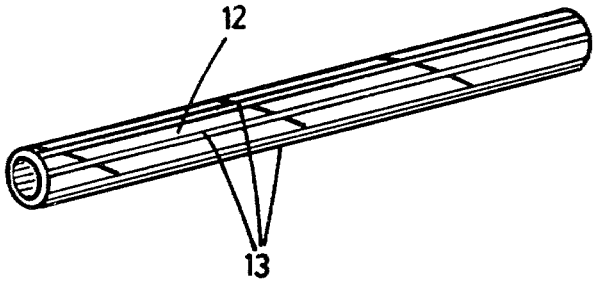

FIG. 3 shows another embodiment in which longitudinal glue stripes have been applied on the core 12.

Further alternatives of applying glue onto the core are of course possible, eg. the glue can form a dot pattern.

Figure 4:
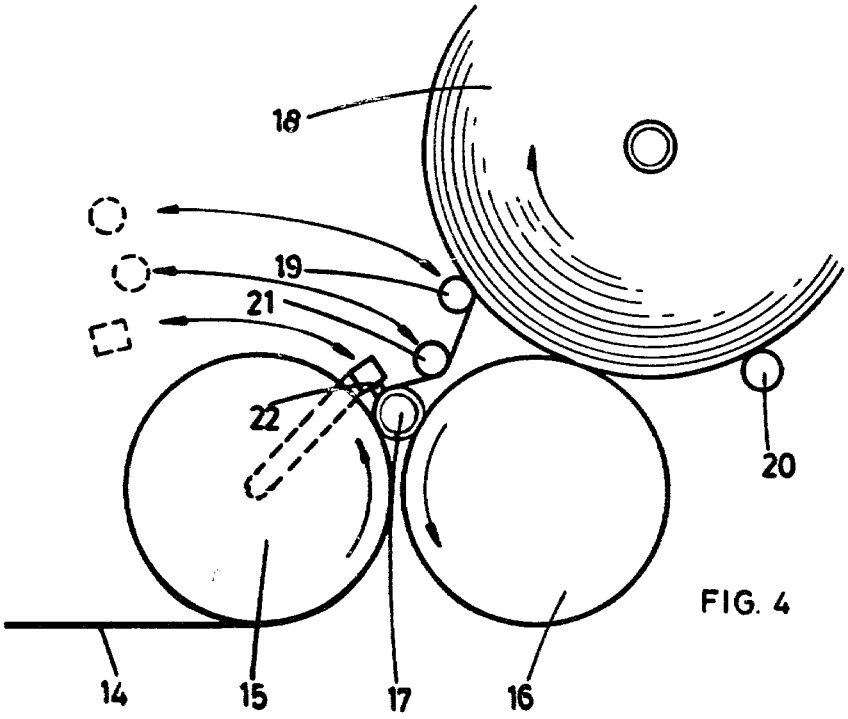
FIG. 4 is a schematic view of an apparatus for using the core for winding webs of material.

FIG. 4 shows a winder in which the winding of a paper web 14 on a core according to the invention takes place on two supporting drums 15 and 16. The paper web is brought to the roll guided by one of the supporting drums 15. The drawing shows the phase in the winding process in which the winding of a roll is completed and the winding of a new roll on a new core 17 is to be started. The new core which is located in the gap between the supporting drums resting on them has been brought into position for instance from the side of the winder by means of well known equipment not shown in the drawing. The fully wound roll 18, the rotational movement of which has been terminated, has been pushed away from its winding position, where it rested on both supporting drums, by means of an ejector roll 19 to a position where it rests on a backing roll 20 and the supporting drum 16, located beside the supporting drum 15, which guides the web, whereby a gap is created between the supporting drum 15 and the fully wound roll. A guide roll 21 which guides the paper web so that it runs along the periphery of the core 17 is introduced through the said gap. With the help of a heating and pressing device 22 which is introduced through the gap between the supporting drum 15 and the roll 18 the paper web is pressed against the core 17 and the glue on the core is heated through the paper web until it melts. When the device 22 is removed the glue congeals and the web is secured to the core. Thereafter the web is cut between the new core and the fully wound roll by means of a severing device not shown in the drawing, as it may be of any well known types that cut the web with a knife or other severing means, after which the fully wound roll is ejected and the winding of the new roll can be initiated. During winding the ejector roll 19, the guide roll 21 and the heating and pressing device 22 are maintained in their initial positions beside the supporting drum 15.

The heating device which heats the glue layer up to a temperature of about 80° C., at which the glue melts, preferably comprises electric resistance heating elements which extend over the paper web. The temperature and the pressing time of the heating element can be adjusted to correspond to the prevailing conditions; the melting point of the glue and the thickness of the paper glued are the decisive factors. Also other means can be used to heat the glue, eg. heat can be generated by microwaves or the glue can be heated either directly or indirectly by means of hot gases. In the embodiment according to FIG. 3 the same device is used to carry out the heating and pressing operations but it is naturally possible to use separate means, which are independently applied, to perform each function.

Figure 5:
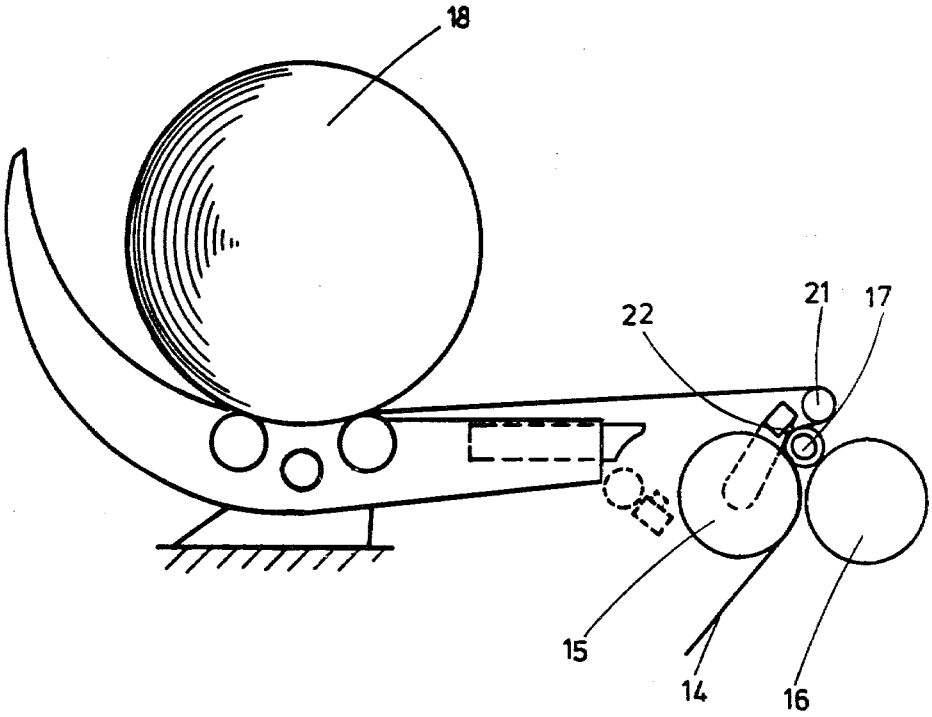
FIGS. 5 and 6 show two alternative embodiments of the apparatus.

FIG. 5 shows a winder in which the fully wound roll 18 is pushed away to the opposite direction shown in FIG. 4 after having been wound on the supporting drums 15 and 16. In the same way as in FIG. 4, the web is caused to run along the periphery of the new core 17 by means of a guide roll 21 and the glue on the core is heated and the web 14 pressed against the core by means of a heating and pressing device 22.

Figure 6:
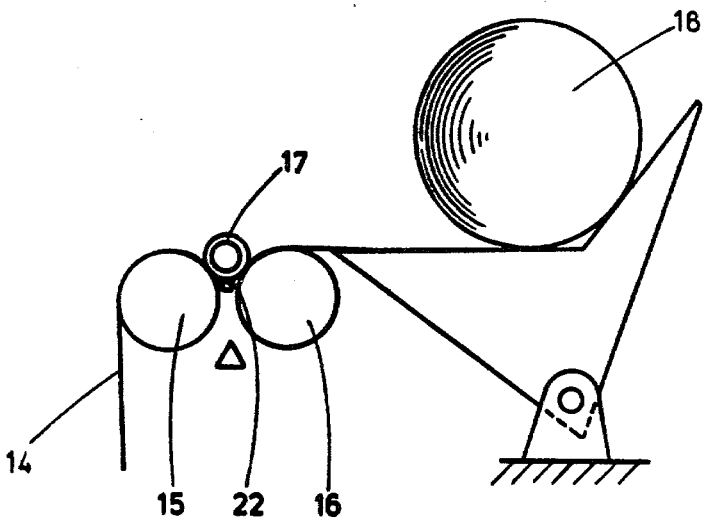

FIG. 6 shows a winder in which a paper web 14 is conducted to the roll 18 over the supporting drums 15 and 16. In this embodiment, the new core 17 rests on the paper web. The heating and pressing device 22 is brought into the heating and pressing position through the gap between the supporting drums.

What we claim is:

1. In the method of winding a web of material into a web roll upon a rotatably driven core having a hot-melt adhesive deposited upon an outer surface of the core, and wherein the web being wound is fed from a supply thereof and is secured to the core by said hot-melt adhesive, and there is maintained an infeed length of web extending from said supply to the tangential winding point of the web being currently wound, and a new core is positioned in tangential contact with said infeed length of web, the improvement which comprises the steps of supporting the new core on a pair of rotatably driven parallel rollers that drivingly engage the new core for winding the infed web thereupon; concurrently applying heat and a pressing force to and through the infed web at the zone of tangential contact thereof with the new core to heat the hot-melt adhesive on the new core and set such adhesive in its active state, and to press the infed web securing the infed web to the new core along said zone of tangential contact; and severing the infed web at a location between the tangential winding point of the web roll currently being wound and the zone of tangential contact with the new core to allow removal of the currently wound web roll and to allow rotatable driving of the new core for continual winding of the infed into a web roll upon the new core.

2. In an apparatus for winding a web of material onto a web roll upon a core having a hot-melt adhesive deposited upon an outer surface of the core, and including means to rotatably drive said core and web roll, and web feeding means operable to feed the web from a supply thereof, said web being secured to the core by the hot-melt adhesive, said web feeding means maintaining an infeed length of web extending from said supply to the tangential winding point of the web roll being currently wound, and including means operable to position a new core in tangential contact with said infed length of web, the improvement which comprises a pair of rotatably driven parallel rollers that support the new core and drivingly engage same for winding the infed web thereupon; means operable to concurrently apply heat and a pressing force to and through the infed web at the zone of tangential contact thereof with the new core to heat the hot-melt adhesive on the new core and set such adhesive in its active state, and to press the infed web against said hot-melt adhesive thereby securing the infed web to the new core along said zone of tangential contact; and means operable to sever the infed web at a location between the tangential winding point of the web roll currently being wound and the zone of tangential contact with the new core to allow removal of the currently wound web roll and the rotatable driving of the new core by said rollers for continued winding of the infed web into a web roll upon the new core.

* * * * *